US006953075B2

(12) United States Patent
Nien

(10) Patent No.: US 6,953,075 B2
(45) Date of Patent: Oct. 11, 2005

(54) VENETIAN BLIND HAVING LIFT CORD STOPPER

(75) Inventor: Ming Nien, Changhua Hsien (TW)

(73) Assignee: Nien made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/780,562

(22) Filed: Feb. 19, 2004

(65) Prior Publication Data

US 2004/0182524 A1 Sep. 23, 2004

(30) Foreign Application Priority Data

Mar. 17, 2003 (TW) ..... 92204433 U

(51) Int. Cl.[7] ..... E06B 9/38

(52) U.S. Cl. ..... 160/168.1 R

(58) Field of Search ..... 160/168.1 R, 176.1 R, 160/173 R, 178.1 R, 178.2 R, 177 R, 172 R, 160/170 R, 171 R

(56) References Cited

U.S. PATENT DOCUMENTS

| | | | | |
|---|---|---|---|---|
| 3,777,800 | A * | 12/1973 | Susoev | 160/84.04 |
| 4,739,815 | A * | 4/1988 | Altman | 160/84.01 |
| 6,453,974 | B1 | 9/2002 | Lai et al. | |
| 6,571,854 | B1 * | 6/2003 | Palmer et al. | 160/173 R |

* cited by examiner

*Primary Examiner*—David Purol
(74) *Attorney, Agent, or Firm*—Browdy and Neimark, PLLC

(57) ABSTRACT

A Venetian blind is constructed to include a headrail, a bottom rail, a plurality of slats, a blind supporting system suspendedly and spacedly supporting the slats horizontally between the headrail and the bottom rail, two lift cords each having a first end fastened to the bottom rail and a second end extending upwardly through the slats into the headrail and then downwardly through a gate of a lift lock mounted in the headrail and terminating in an operation segment suspended below the headrail at a distance, and a knot constructed in each lift cord and having a dimension greater than the gate of the lift lock. Therefore, the knot limits the moving distance of the respective lift cord relative to the lift lock and, prevents a sudden dropping of the bottom rail upon failure of the lift lock.

4 Claims, 6 Drawing Sheets

VENETIAN BLIND HAVING LIFT CORD STOPPER

BACKGROUND OF THE INVENTION

1. Field of the Invention

The present invention relates generally to window blind assemblies and, more particularly, to a blind having a safety lift cord stopper assembly.

2. Description of the Related Art

Venetian blinds are intensively used in building construction to regulate light passing through windows and to decorate windows. FIG. 1 illustrates a regular Venetian blind, which comprises a headrail 11, a bottom rail 12, a set of slats 14 arranged in parallel between the headrail 11 and the bottom rail 12, pairs of ladder tapes 13 symmetrically and bilaterally connected between the headrail 11 and the bottom rail 12 and joining the slats 14, two lift cords 15 each having a fixed end respectively fixedly fastened to the bottom rail 12 and a free end 151 respectively upwardly extended through (a respective through hole in) each slat 14 and the headrail 11 and then extended out of a bottom opening near one end of the headrail 11, and a lift lock 16 installed in the headrail 11 and adapted to lock the lift cords 15. Operating the lift cords 15 controls the elevation of the bottom rail 12. This structure of Venetian blind is not safe in use because the cord segment 152 of each lift cord 15 passing through the slats 14 may accidentally be wound round the neck of child playing the Venetian blind for fun. Further, in case the lift lock 16 failed, the slats 14 and the bottom rail 12 may fall suddenly to hit a person passing or standing below the Venetian blind.

FIG. 2 illustrates a Venetian blind constructed according to U.S. Pat. No. 6,453,974. According to this design of blind assembly, two cord stoppers 22 are respectively slidably connected on the lift cords 21. The cord stoppers 22 are adapted to move upwardly along the lift cords 21. When the cord stoppers 22 moved along the lift cords 21 to an upper position and stopped at the opening for lift lock 24 in the bottom side of the headrail 23, the folding condition of the slats of the Venetian blind is locked, and the segment 25 of each lift cord 21 passing through the slats of the Venetian blind is prohibited from stretching. The cord stoppers 22 each include a locking guider slidably connected on one lift cord 21 of the Venetian blind by constructing an adjustable knot at a guiding through slot of the locking guider. According to this design, it is complicated and inconvenient to construct an adjustable knot at the guiding through slot of the locking guider of each cord stopper 22.

Therefore, it is desirable to provide a Venetian blind that eliminates the aforesaid drawbacks.

SUMMARY OF THE INVENTION

The present invention has been accomplished to provide a safety Venetian blind, which eliminates the aforesaid drawbacks. It is therefore the main object of the present invention to provide a safety Venetian blind, which has means to stop the lift cord segment of each lift cord passing through the slats from stretching.

It is another object of the present invention to provide a safety Venetian blind, which has means to stop the bottom rail from falling when the lift lock has failed.

It is still another object of the present invention to provide a safety Venetian blind, which has a simple structure of a lift cord stopper.

To achieve these objects of the present invention, the Venetian blind comprises a headrail, a bottom rail, a plurality of slats, a blind supporting system suspendedly and spacedly supporting the slats horizontally between the headrail and the bottom rail, two lift cords each having a first end fixedly fastened to the bottom rail and a second end extending upwardly through the slats into the headrail and then downwardly through a lift lock in a bottom side of the headrail and terminating in an operation segment suspended below the headrail at a distance, and a knot constructed in each lift cord. The knot has a dimension greater than a gate of the lift lock through which the lift cords pass. Therefore, the knot limits the moving distance of the respective lift cord relative to the lift lock and, prevents a sudden dropping of the bottom rail upon failure of the lift lock.

DETAILED DESCRIPTION OF THE INVENTION

Figure 1:
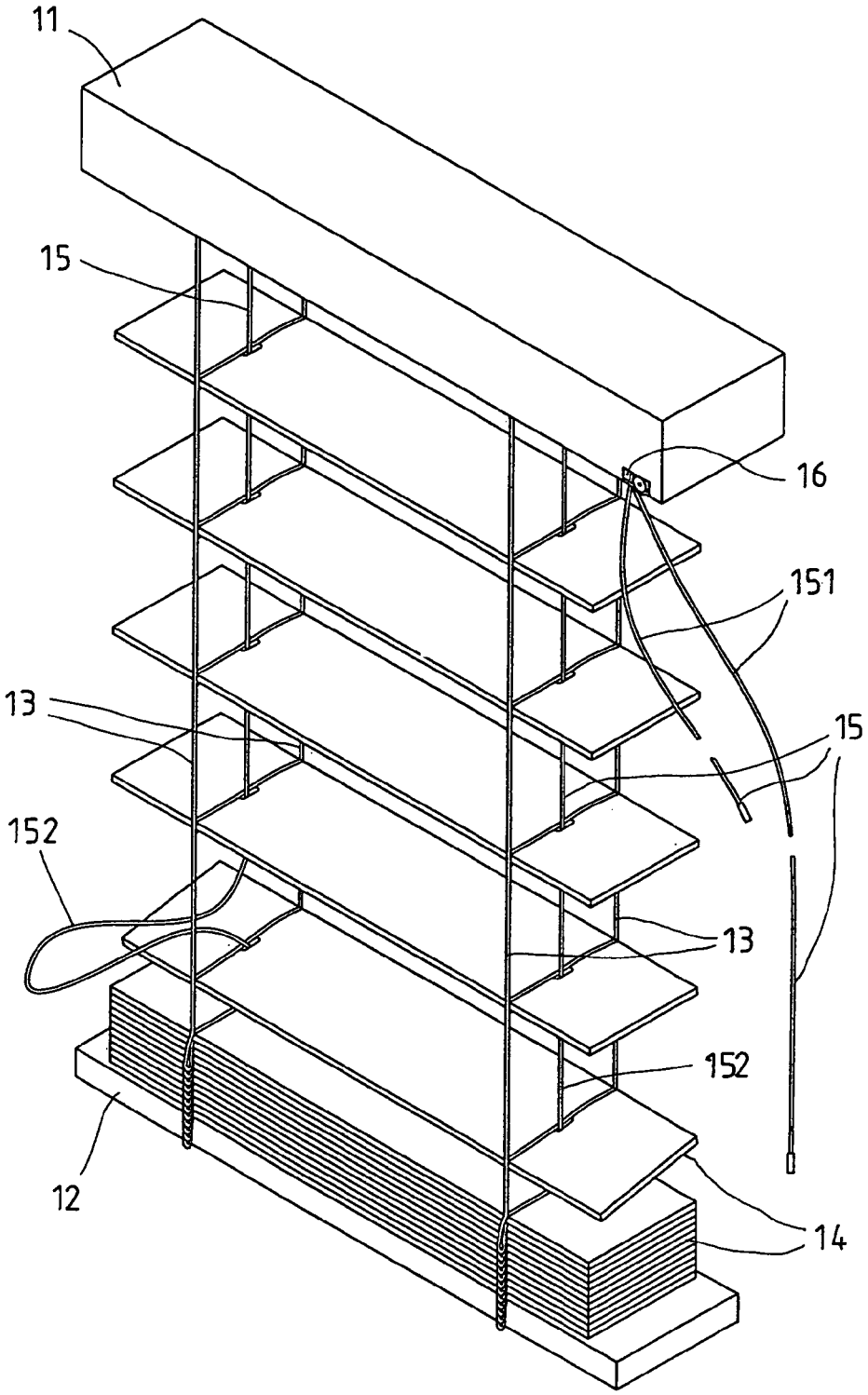
FIG. 1 PRIOR ART
FIG. 1 is a schematic drawing showing a lift cord stretching status of a Venetian blind according to the prior art.
Figure 2:
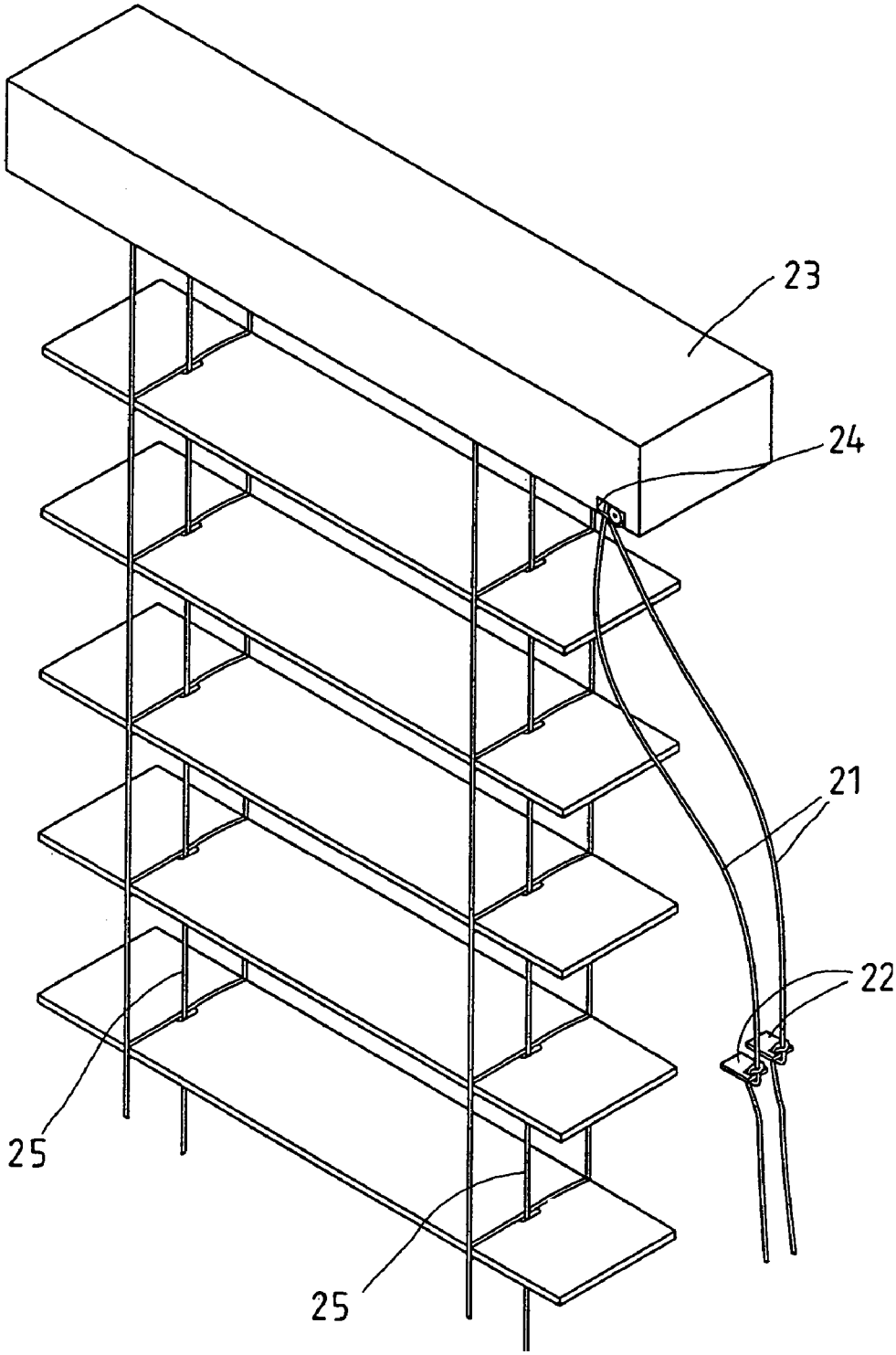
FIG. 2 PRIOR ART
FIG. 2 illustrates the outer appearance of a Venetian blind according to U.S. Pat. No. 6,453,974.
Figure 3:
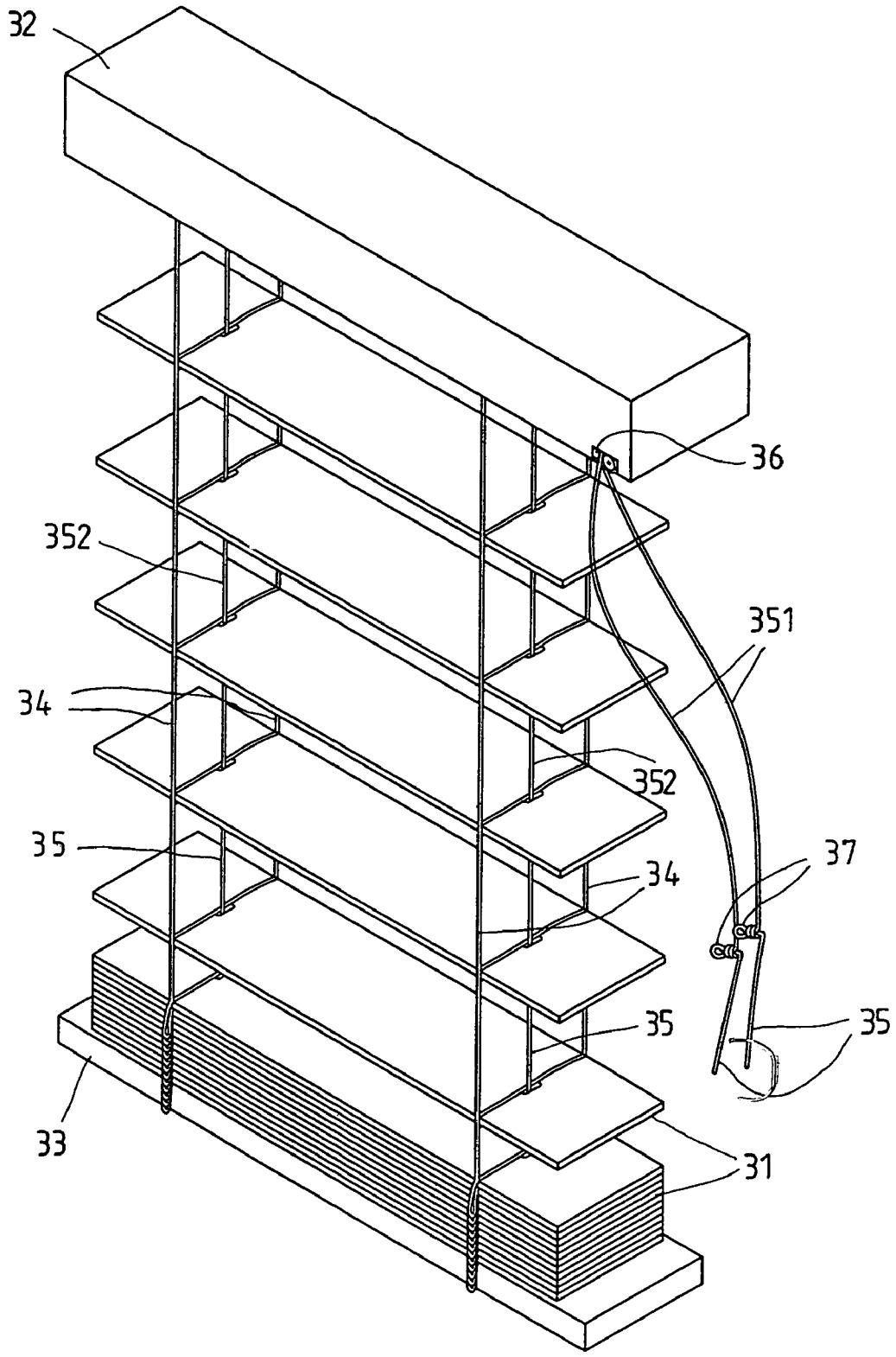
FIG. 3 illustrates the outer appearance of a safety Venetian blind constructed according to a first preferred embodiment of the present invention.
Figure 4:
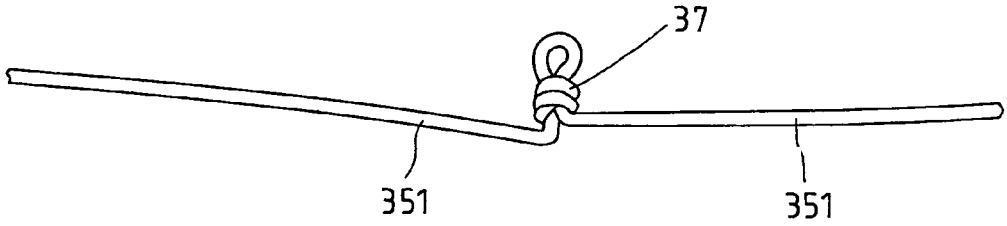
FIG. 4 illustrates a knot constructed in one lift cord according to the first preferred embodiment of the present invention.
Figure 5:
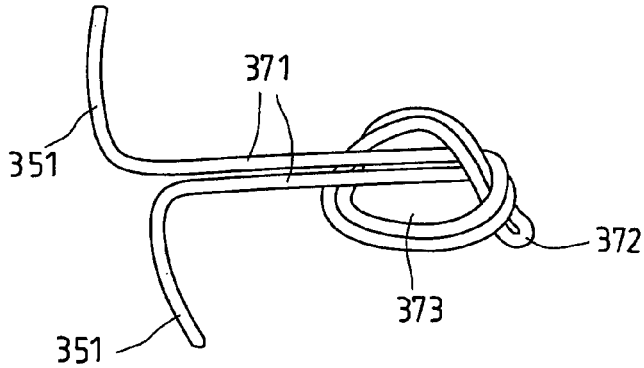
FIG. 5 is a schematic drawing showing the construction of the knot in the lift cord according to the first preferred embodiment of the present invention.

Referring to FIGS. 3~5, a safety Venetian blind in accordance with the first preferred embodiment of the present invention is shown, similar to a conventional Venetian blind, comprising a headrail 32, a bottom rail 33, a plurality of slats 31 arranged in parallel between the headrail 32 and the bottom rail 33, a blind supporting system, i.e., symmetrical pairs of ladder tapes 34 for suspendedly and spacedly supporting the slats 31 horizontally between the headrail 32 and the bottom rail 33, and two lift cords 35 for controlling the elevation of the bottom rail 33, and a lift lock 36 mounted in the headrail 32 near one end and adapted to lock the lift cords 35. The lift cords 35 each has one end fixedly fastened to the bottom rail 33, and the other end extending upwardly through the slats 31 into the inside of the headrail 32 and then rightwards toward the right end of the headrail 32 and then downwardly through the lift lock 36 to the outside of the headrail 32. The user adjustably divides each lift cord 35 into a lifting segment 352 that passes through the slats 35 and the headrail 32, and an operation segment 351 that extends out of the headrail 32 for pulling. Further, each lift cord 35 has a knot 37 constructed in the respective operation segment 351. When the knots 37 of the lift cords 35 are kept at same elevation (horizontally aligned), they are spaced from the lift lock 36 and the headrail 32 at a distance. The dimension of the knot 37 is greater than a gate in the lift lock 36 through which the lift cords 35 pass. As illustrated in FIGS. 4 and 5, a part of the operation segment 351 is folded up, forming a base strand 371 having a U-turn tip 372. The U-turn tip 372 is then detoured and turned round the base strand 371 through one turn, and then inserted through the eye 373 thus formed. When the U-turn tip 372 tightly stretched after having been inserted through the eye 373, the knot 37 is done.

Normally, the lift lock 36 controls the sliding status of the lift cords 35. When the lift lock 36 fails, the slats 31 and the bottom rail 33 will drop due to the effect of their gravity weight, thereby causing the operation segment 351 of each lift cord 35 to move relative to the lift cord 35 toward the inside of the headrail 32. When the operation segment 351 of each lift cord 35 moving toward the inside of the headrail 32, the respective knot 37 will be stopped at the lift lock 36 to limit the downward movement of the bottom rail 33 and the slats 31 within a predetermined safety range, preventing the falling bottom rail 33 from hitting a person.

Figure 6:
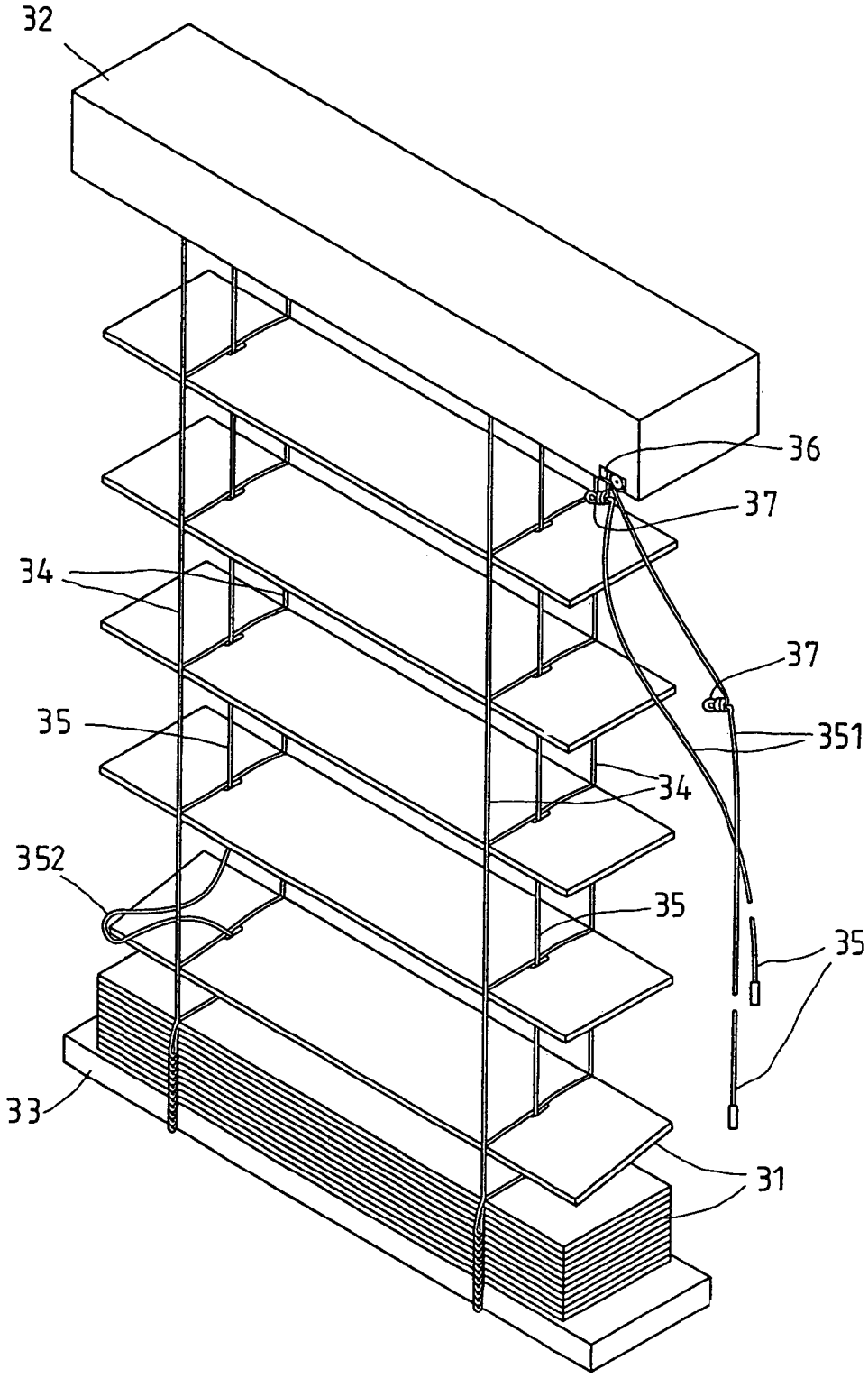
FIG. 6 illustrates the lifting segment of one lift cord of the safety Venetian blind stretched, the knot of the corresponding lift cord stopped at the lift lock according to the present invention.

Referring to FIG. 6, when a child pulling the lifting segment 352 of one lift cord 35 for fun, the knot 37 of the corresponding lift cord 35 will be stopped at the lift lock 36 to limit the stretching of the lift cord 35.

As indicated above, the safety Venetian blind of the present invention achieves advantages as follows:

1. The knot 37 in each lift cord 35 limits the sliding distance of the respective lift cord 35 relative to the lift lock 36, prevents a sudden falling of the bottom rail 33 upon failure of the lift lock 36.

2. The vertical moving distance of the bottom rail 33 and the stretching distance of the lifting segment 352 of the respective lift cord 35 can be controlled by adjusting the position of the knot 37 in each lift cord 35.

3. The invention can be employed to conventional Venetian blinds without changing the original structural design.

4. The knot 37 can easily be constructed in the operation segment 351 of each lift cord 35, and will not loosen when fastened tight.

5. The formation of the knot 7 in the operation segment 351 of each lift cord 35 does not destroy the whole sense of beauty of the Venetian blind.

Figure 7:
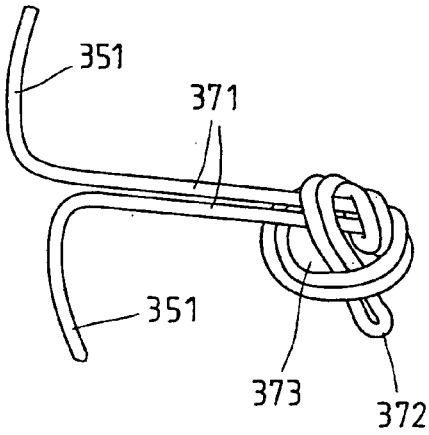
FIG. 7 is a schematic drawing showing an alternate form of the knot according to the first preferred embodiment of the present invention.
Figure 8:
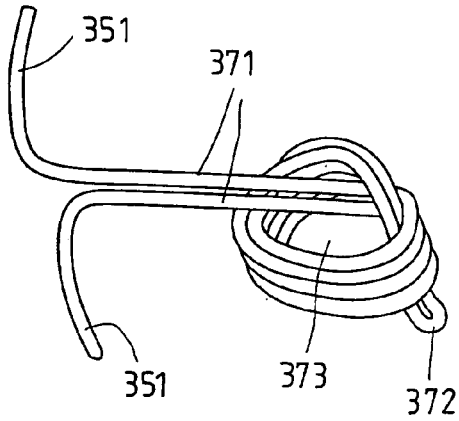
FIG. 8 is a schematic drawing showing another alternate form of the knot according to the first preferred embodiment of the present invention.

The aforesaid knot 37 may be constructed in another way. As illustrated in FIGS. 7 and 8, the U-turn tip 372 of the cord strand 371 is detoured and turned round the cord strand 371 through two or several turns, and then inserted through the eye 373 once or more times thus formed and stretched tight.

Figure 9:
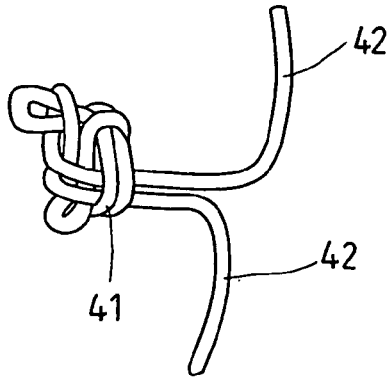
FIG. 9 illustrates the configuration of a knot constructed in a lift cord according to a second preferred embodiment of the present invention.
Figure 10:
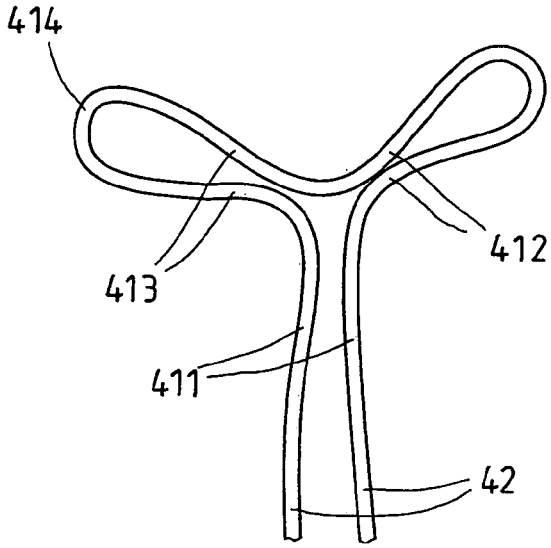
FIG. 10 is a schematic drawing showing a formation procedure of the knot according to the second embodiment of the present invention.
Figure 11:
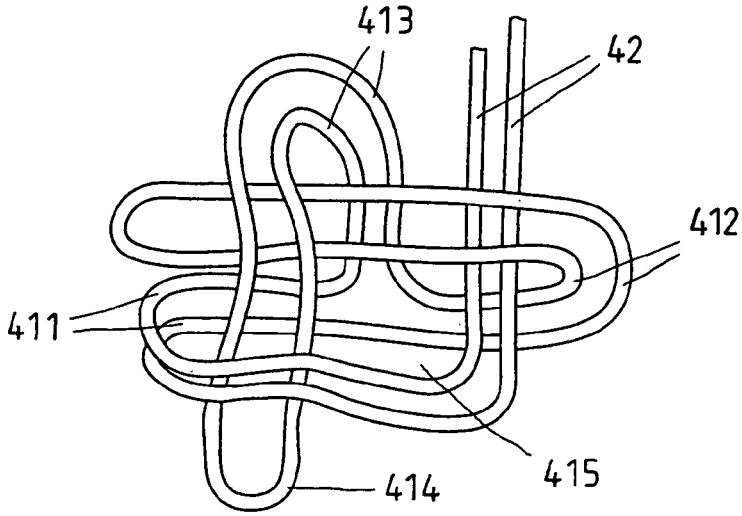
FIG. 11 is a schematic drawing showing a further formation procedure of the knot according to the second embodiment of the present invention.

FIGS. 9~11 show a knot 41 constructed in the operation segment 42 of a lift cord according to the second preferred embodiment of the present invention. According to this embodiment, one part of the operation segment 42 is folded up, forming a detoured base strand 411, and then the first side portion 412 and second side portion 413 of the detoured base strand 411 are respectively folded up, forming a respective U-turn tip 414, and then the detoured base strand 411 is turned over the U-turn tip 414 of the first side portion 412, forming an eye 415, and then the U-turn tip 414 of the first side portion 412 is turned over the U-turn tip 414 of the second side portion 413, and then the U-turn tip 414 of the second side portion 413 is turned over the base strand 411 and then inserted through the eye 415 formed by the base strand 411 and stretched tight. A knot 41 constructed according to this embodiment has a nice outer looking and a relatively bigger dimension than the knot 37 shown in FIG. 3 or 6.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A Venetian blind comprising:

a headrail;

a bottom rail;

a plurality of slats;

a blind supporting system suspended from the headrail and supporting said slats horizontally and spaced apart between said headrail and said bottom rail;

a lift cord having a first end fixed to said bottom rail and a second end extending upwardly through said slats into said headrail and then downwardly through a gate of a lift lock mounted in said headrail and terminating in an operation segment suspended below said headrail for a distance; and wherein a knot is formed by holding up a middle part of the suspended operation segment of said lift cord to form a base strand having a U-turn tip, and then detouring said U turn tip and turning U-turn tip round said base strand through at least one turn to form an eye, and then inserting said U-turn tip through said eye at least once and then stretching said U-turn tip tightly;

wherein the knot constructed in said lift cord has a dimension greater than a gate of said lift lock.

2. A venetian blind comprising:

a headrail;

a bottom rail;

a plurality of slats;

a blind supporting system suspending from the headrail and supporting said slats horizontally and spaced apart between said headrail and said bottom rail;

a lift cord having a first end fixed to said bottom rail and a second end extending upwardly through said slats into said headrail and then downwardly through a gate of a lift lock mounted in said headrail and terminating in an operation segment suspended below said headrail for a distance; and wherein a knot is formed by folding up a middle part of the suspended operation segment of said lift cord to form a detoured base strand, and then respectively folding up a first side portion and a second side portion of said detoured base strand to form a respective U-turn tip, and then turning said detoured base strand over the U-turn tip of said first side portion to form an eye, and then turning the U-turn tip of said first side portion over the U-turn tip of said second side portion, and then turning the U-turn tip of the second side portion over the base strand and then inserting the U-turn tip of said second side portion through said eye and then stretching the U-turn tip of said second side portion tightly;

wherein the knot constructed in said lift cord has a dimension greater than a gate of said lift lock.

3. The Venetian blind as claimed in claim 1, wherein said blind supporting system comprises at least two ladder tapes.

4. The Venetian blind as claimed in claim 2, wherein said blind supporting system comprises at least two ladder tapes.

* * * * *